US007949271B2

(12) United States Patent
Naruge

(10) Patent No.: US 7,949,271 B2
(45) Date of Patent: May 24, 2011

(54) IMAGE FORMING APPARATUS USING A CONTROLLER CONFIGURED TO CONTROL A DEVELOPING BIAS TO BE APPLIED TO DEVELOPER BEARING MEMBER BASED ON A INPUT WAVEFORM BIAS AND AN OUTPUT WAVEFORM BIAS

(75) Inventor: Shoji Naruge, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 12/237,990

(22) Filed: Sep. 25, 2008

(65) Prior Publication Data

US 2009/0087205 A1 Apr. 2, 2009

(30) Foreign Application Priority Data

Sep. 27, 2007 (JP) ..... 2007-251889

(51) Int. Cl.
*G03G 15/08* (2006.01)

(52) U.S. Cl. ..... 399/55

(58) Field of Classification Search ..... 399/55, 399/88, 270, 285
See application file for complete search history.

(56) References Cited

U.S. PATENT DOCUMENTS

| | | | | |
|---|---|---|---|---|
| 5,519,471 | A * | 5/1996 | Nishimura et al. | 399/284 |
| 5,521,683 | A * | 5/1996 | Miyamoto et al. | 399/55 |
| 6,889,017 | B2 | 5/2005 | Park et al. | |
| 7,039,333 | B2 * | 5/2006 | Do | 399/53 |
| 7,103,294 | B2 * | 9/2006 | Kawano | 399/55 |
| 2004/0018025 | A1 | 1/2004 | Park et al. | |

FOREIGN PATENT DOCUMENTS

| | | | |
|---|---|---|---|
| JP | 03111867 | A * | 5/1991 |
| JP | 09-054487 | A | 2/1997 |
| JP | 2000-214665 | A | 8/2000 |
| JP | 2004-054297 | A | 2/2004 |

* cited by examiner

*Primary Examiner* — Robert Beatty
(74) *Attorney, Agent, or Firm* — Canon U.S.A. Inc., I.P. Division

(57) ABSTRACT

A development device configured to develop an electrostatic image formed on an image bearing member by applying a developing bias in a development operation includes a developer bearing member configured to bear a developer, a bias applying unit configured to apply an input waveform bias including an alternating component to the developer bearing member, a bias detection unit configured to detect information concerning an output waveform bias generated on the developer bearing member when the bias applying unit applies the input waveform bias to the developer bearing member, and a controller configured to execute a mode for controlling the developing bias to be applied to the developer bearing member based on the input waveform bias and the output waveform bias.

8 Claims, 19 Drawing Sheets

IMAGE FORMING APPARATUS USING A CONTROLLER CONFIGURED TO CONTROL A DEVELOPING BIAS TO BE APPLIED TO DEVELOPER BEARING MEMBER BASED ON A INPUT WAVEFORM BIAS AND AN OUTPUT WAVEFORM BIAS

BACKGROUND OF THE INVENTION

1. Field of the Invention

The present invention relates to a development device provided in an electrophographic image forming apparatus (e.g., a copying machine, a laser beam printer, or a facsimile machine) The development device develops an electrostatic image formed on an image bearing member (e.g., photosensitive drum).

2. Description of the Related Art

In an image forming apparatus using electrophographic processes, a development device is configured to apply developer onto an electrostatic image formed on an image bearing member (e.g., photosensitive drum) to develop the electrostatic image as a toner image.

The development device includes a developing sleeve that carries and conveys developer. The developing sleeve is spaced from a photosensitive drum by a predetermined gap (hereinafter, referred to as "S-D (Sleeve-Drum) gap"). The development device, when it performs a development operation, applies a developing bias to the developing sleeve. The developing bias is a bias including a direct-current (DC) voltage component and an alternating-current (AC) voltage component. The developing sleeve includes regulating members (abutment rollers) provided at both ends thereof. The regulating members, when brought into contact with the photosensitive drum, maintain the above-described predetermined S-D gap between the developing sleeve and the photosensitive drum.

However, according to the above-described arrangement, if toner particles adhere to the surface of abutment rollers or the abutment rollers are worn down during a long-term use, the S-D gap may deviate from the originally set value.

FIG. 4 illustrates an example waveform of the developing bias. The waveform illustrated in FIG. 4 includes a first peak value Vmax applied during time T1 and a second peak value Vmin applied during time T2. An electric field formed when the first peak value Vmax is applied urges toner in a predetermined direction, from the developing sleeve to the photosensitive drum. An electric field formed when the second peak value Vmin is applied urges toner in the opposite direction, from the photosensitive drum to the developing sleeve. The bias having such a waveform is generally referred to as "duty bias." An amplification circuit can generate a developing bias by amplifying a predetermined basic waveform. A waveform including a rectangular portion, which can realize a quick rise, is desired to develop a visible image having high image quality.

A transient response relative to the electrostatic capacitance of the S-D gap occurs when a developing bias is applied to the S-D gap. Therefore, a waveform resulting from an electrical potential change of the sleeve has a shape different from that of an input waveform.

FIG. 3 illustrates a general resistor-capacitor (RC) circuit and its transient characteristics. The RC circuit starts charging a capacitor upon closing a switch S. When a constant voltage is applied, the voltage across the capacitor changes with a rise time determined by a resistance R and a capacitance C. If a power source voltage V0 is high, the charging speed is high and the voltage across the capacitor rises quickly. The electrostatic capacitance in an image forming apparatus is determined according to the distance of the S-D gap, materials contained in the developer, and the shape of magnetic brush. For example, if the S-D gap is narrow, the electrostatic capacitance is large and a long time is required to store electric charge. Therefore, the waveform at a rise portion becomes dull (as indicated by a dotted line in FIG. 4). The developing performance deteriorates and the image density decreases.

Deterioration in developing performance is described below in more detail. FIG. 7 illustrates toner flying from a magnetic brush generated when a developing bias is applied to a developing sleeve 21. The electric field concentrates at a front edge of the magnetic brush where the gap between the magnetic brush and the photosensitive drum 11 is shortest. A repulsive force constantly acts on toner particles because of their electric charges having the same polarity. Therefore, the flying of toner particles successively occurs at or near the front edge of the magnetic brush. If the developing bias is dull in its rise portion, the electric field has a dull rise at the front edge of the magnetic brush. Therefore, the flying of toner particles starts at delayed timing. An AC bias alternately applies positive and negative electric fields to the S-D gap within a limited time. Accordingly, the amount of flying toner particles decreases when the flying of toner particles starts at delayed timing. As a result, the developing performance deteriorates or the image density decreases.

On the other hand, if the S-D gap is wide, the electrostatic capacitance is small and the time required for charging is short. However, the rising voltage may momentarily exceed the predetermined peak value Vmax (which is referred to as "overshoot") as indicated in FIG. 5. In FIG. 5, a solid line represents a basic waveform and a dotted line represents a waveform causing an overshoot when the electrostatic capacitance is small. If the overshoot phenomenon repetitively occurs, the amount of conductive substances increases in the developer and abnormal discharge occurs in the S-D gap. If abnormal discharge occurs on or near the drum surface, a ring-shaped defective image (ring mark) appears on the drum surface at a corresponding position due to a decrease in the electrical potential.

Accordingly, applying a developing bias having a desired waveform is important to assure stable developing performance. To this end, performing initial setting for a sharp rise can maintain the shape of a waveform as indicated by the solid line in FIG. 5. For example, as discussed in Japanese Patent Application Laid-Open No. 2000-214665, a waveform shaping resistance can be serially connected to a developing device to adjust the deformation of a waveform if the deformation occurs due to initial differences of the individual developing device.

However, a change of the electrostatic capacitance C of the S-D gap is greatly dependent on the elapsed time because the electrostatic capacitance C is variable according to the distance of the S-D gap, materials contained in the developer, and the shape of magnetic brush. Therefore, even after each of the power source side and the developing device side is adjusted to assure a predetermined value as described in Japanese Patent Application Laid-Open No. 2000-214665, the waveform may deform due to a change in the electrostatic capacitance during a long-term use of the apparatus. The deformation in waveform greatly influences the quality of an image.

To solve the above-described problem, a method discussed in Japanese Patent Application Laid-Open No. 9-54487 includes applying a bias to a developing sleeve and changing a DC offset bias applied to the developing sleeve, or a peak-to-peak voltage of an applied rectangular voltage, according to the output current. The method prevents the toner density from varying when the gap between an image bearing member and a developer bearing member changes.

However, according to the method discussed in Japanese Patent Application Laid-Open No. 9-54487, it is required to change the DC offset voltage applied to the developing sleeve or the peak-to-peak voltage of the AC voltage. For example, if the DC offset voltage is changed, a Vback representing a difference between the developing electrical potential and an electrical potential of a dark portion decreases and carrier adhesion easily occurs. On the other hand, if the peak-to-peak voltage is changed, abnormal discharge easily occurs because of the increased peak-to-peak voltage.

A method discussed in Japanese Patent Application Laid-Open No. 2004-54297 includes calculating the resistance of a developing roller and the SD gap and changing the amplitude and the duty ratio of an applied AC voltage. The method can prevent the toner density from varying when the gap between an image bearing member and a developer bearing member changes.

However, similar to the method discussed in Japanese Patent Application Laid-Open No. 9-54487, the method discussed in Japanese Patent Application Laid-Open No. 2004-54297 cannot reduce deterioration in image quality (carrier adhesion or abnormal discharge) occurring due to changes in the amplitude and the duty ratio of the AC voltage.

SUMMARY OF THE INVENTION

Exemplary embodiments of the present invention are directed to a development device capable of maintaining stable developing performance for a long time and capable of reducing deformation of an alternating-current bias waveform regardless of aging changes in the gap between a developer bearing member and an image bearing member.

According to an aspect of the present invention, a development device configured to develop an electrostatic image formed on an image bearing member by applying a developing bias in a development operation includes a developer bearing member configured to bear a developer, a bias applying unit configured to apply an input waveform bias including an alternating component to the developer bearing member, a bias detection unit configured to detect information concerning an output waveform bias generated on the developer bearing member when the bias applying unit applies the input waveform bias to the developer bearing member, and a controller configured to execute a mode for controlling the developing bias to be applied to the developer bearing member based on the input waveform bias and the output waveform bias.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to disclose the invention.

DETAILED DESCRIPTION OF THE EMBODIMENTS

Figure 1:
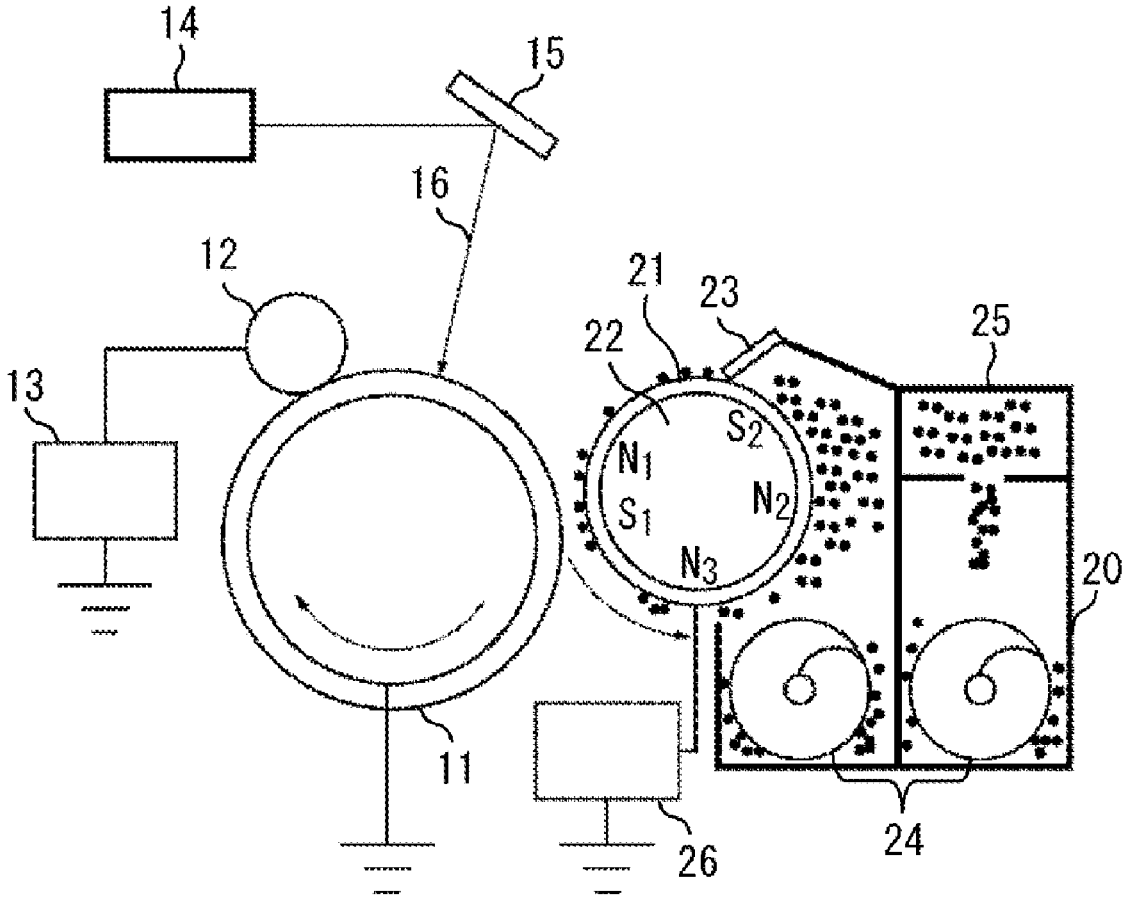
FIG. 1 illustrates an example arrangement of a development device according to an exemplary embodiment of the present invention.

The following description of exemplary embodiments is illustrative in nature and is in no way intended to limit the invention, its application, or uses. It is noted that throughout the specification, like reference numerals and letters refer to like items in the following figures, and thus once an item is described in one figure, it may not be discussed for other figures where such description would be redundant. Exemplary embodiments will be described in detail below with reference to the drawings.

First Exemplary Embodiment

An electrostatic image forming unit illustrated in FIG. 1 includes a photosensitive drum (image bearing member) 11, which has a surface coated with a photosensitive layer, for example constituted by an organic semiconductor. The photosensitive drum 11 rotates at a predetermined speed in a direction indicated by an arrow in FIG. 1. A primary charging device (charging unit) 12, which is disposed around the photosensitive drum 11, uniformly charges the photosensitive drum 11 to have a negative electrical potential as a preparation for latent image forming processing. For example, the negative electrical potential is set to −650 V. A power source 13 applies, to the primary charging device 12, a charging bias that includes a DC bias component and an AC bias component.

Figure 2:
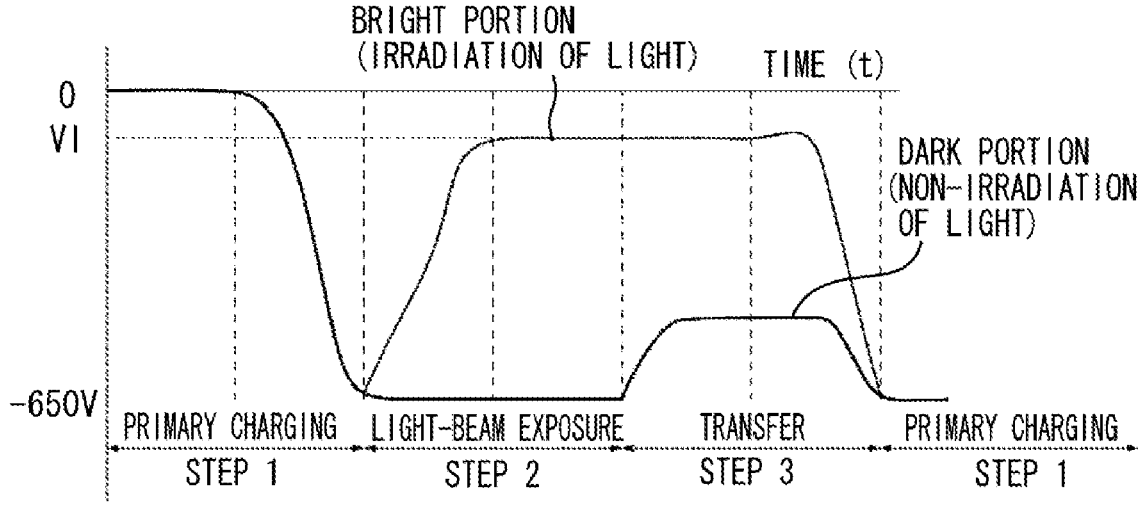
FIG. 2 illustrates example processes performed by an electrostatic image forming unit to generate an electrostatic latent image.
Figure 3:
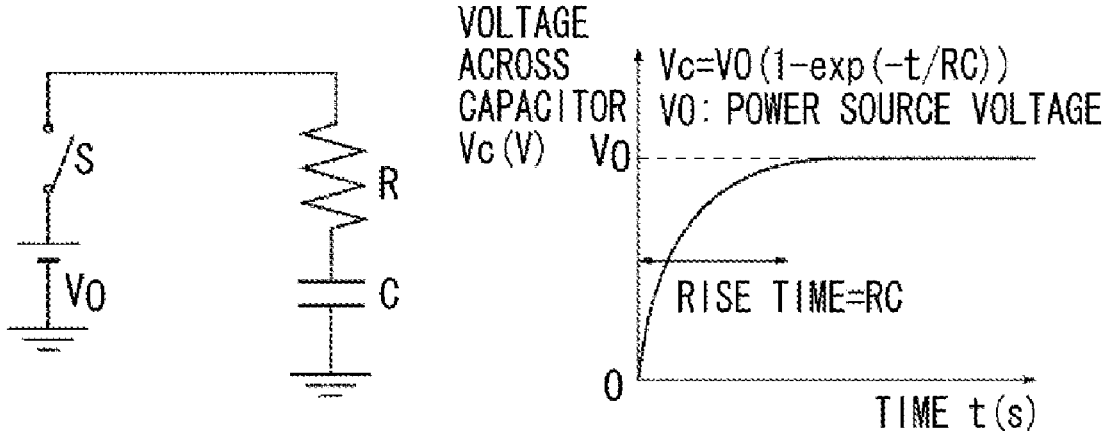
FIG. 3 PRIOR ART
FIG. 3 illustrates a general RC circuit and a transient phenomenon of the voltage across a capacitor.

FIG. 2 illustrates example processes performed by the electrostatic image forming unit to generate an electrostatic latent image. In FIG. 2, step 1 indicates a primary charging process.

The next process is described below referring back to FIG. 1.

A light-beam emission unit (exposure device) 14 includes a light-emitting element, such as a semiconductor laser or a light-emitting diode (LED), which generates a light-beam 16 according to image information. A mirror 15 reflects the light-beam 16 towards the photosensitive drum 11. The light-beam 16 forms an electrostatic image on the photosensitive drum 11. For example, a portion exposed to the light-beam 16 has an electrical potential of −100V. V1 represents the electrical potential on the exposed surface.

In FIG. 2, step 2 indicates an exposure process. A dark portion (i.e., a non-exposed portion) on the surface of the photosensitive drum 11 maintains negative electric charges supplied during the primary charging process. A bright portion (i.e., an exposed portion) on the surface of the photosensitive drum 11 removes negative electric charges. An image formed on the surface of the photosensitive drum 11, i.e., a distribution of negative electric charges, is generally referred to as an "electrostatic image."

The next process (step 3) is described below referring back to FIG. 1. A development device, positioned adjacent the photosensitive drum 11, applies developer onto the surface of the photosensitive drum 11 to develop an electrostatic image formed on the surface of the photosensitive drum 11.

The developing process is described below in detail.

A development container 20 stores developer, which contains non-magnetic toner and magnetic carrier. The development container 20 contains a developing sleeve (developer bearing member) 21, a magnet roller 22, a doctor blade 23, screws 24, and a toner cartridge 25. The screws 24 agitate non-magnetic toner supplied from the toner cartridge 25 and convey the agitated toner towards the developing sleeve 21. The development container 20 has an opening at a position where the developing sleeve 21 faces the photosensitive drum 11 with a predetermined gap between them. The developing sleeve 21 can rotate in a direction indicated by an arrow. The magnet roller 22, provided in the developing sleeve 21, generates a magnetic force to attract and hold developer on the surface of the developing sleeve 21.

The doctor blade 23 regulates the thickness of a developer layer adhering to the developing sleeve 21, which rotates in the arrow direction. If the developer has a regulated layer thickness, carriers form magnetic brushes under the magnetic force of the magnet roller 22. Magnetic brushes positioned on the developing sleeve 21 are uniform in length. The developing sleeve 21, while holding magnetic brushes on its surface, rotates to convey the magnetic brushes to the position where the magnetic brush faces the photosensitive drum 11.

Non-magnetic toner can hold electric charges of −6.0 μC/g to −30.0 μC/g when the developer is agitated and carried on the developing sleeve 21 through the above-described processes. The photosensitive drum 11 and the developing sleeve 21, when installed in a developing unit, maintain a predetermined gap of 50 μm to 500 μm between them. The gap (hereinafter, referred to as "S-D gap") is for example set to 300 μm. The developing sleeve 21 may have regulating members provided at both ends thereof. In a state where the regulating members are brought into contact with the photosensitive drum 11, the S-D gap between the photosensitive drum 11 and the developing sleeve 21 is equalized to a predetermined distance.

Figure 8:
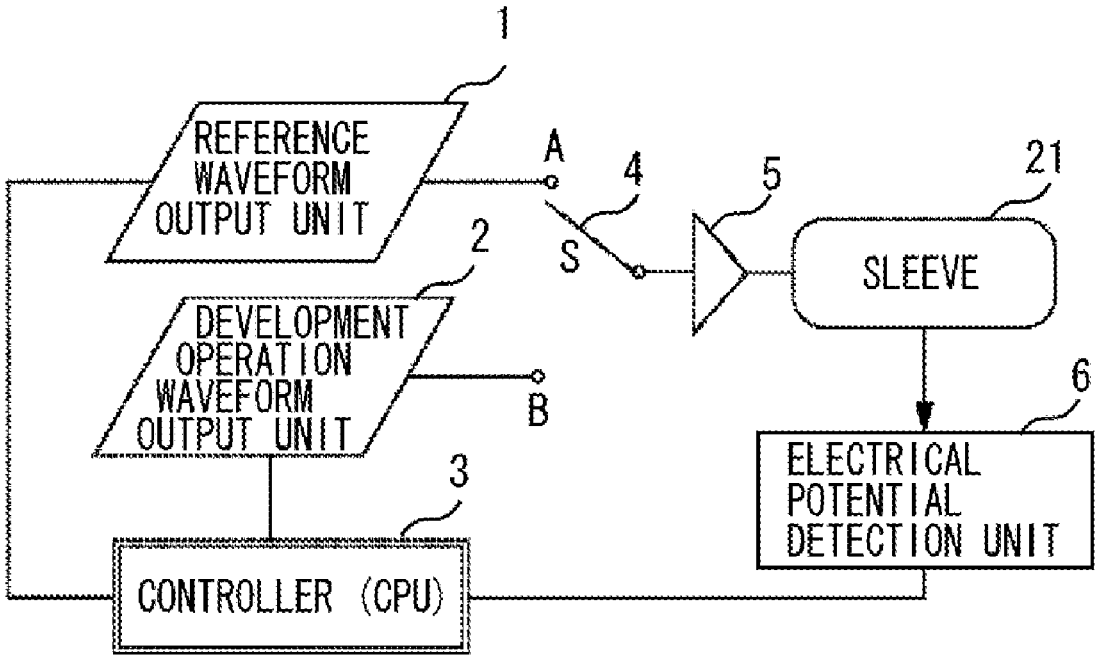
FIG. 8 is a block diagram illustrating a developing bias generation circuit according to an exemplary embodiment of the present invention.

FIG. 8 illustrates an example developing bias generation circuit according to an exemplary embodiment of the present invention. A reference waveform output unit 1 includes a memory, which stores a reference waveform having a rectangular portion. The reference waveform is unchangeable. A development operation waveform output unit 2 temporarily stores a waveform newly generated by a controller (central processing unit (CPU)) 3. The development operation waveform output unit 2 outputs a voltage waveform in response to an instruction from the controller 3.

A bias applying unit 5 selectively receives a waveform output from the reference waveform output unit 1 or the development operation waveform output unit 2. The bias applying unit 5 generates a bias based on the input waveform and applies the generated bias to the developing sleeve 21. The bias applying unit 5 amplifies the input waveform and generates a bias including an alternating-current component. The switch (S) 4 selects an output of the reference waveform output unit 1 or an output of the development operation waveform output unit 2. The bias applying unit 5 receives a signal selected by the switch (S) 4.

The controller 3 calculates a digital waveform. Furthermore, the controller 3 controls transfer of waveform data, controls each storage unit configured to output a waveform, and controls the switch (S) 4. An electrical potential detection unit 6 detects a change in electrical potential of the developing sleeve 21 and transfers the detected change to the controller 3 via a built-in A/D converter (not shown). The electrical potential detection unit 6 is, for example, a surface potential detector that can detect an electrical potential on the surface of the developing sleeve 21 or a voltage detector that can directly detect an output voltage of the bias applying unit 5.

Figure 9:
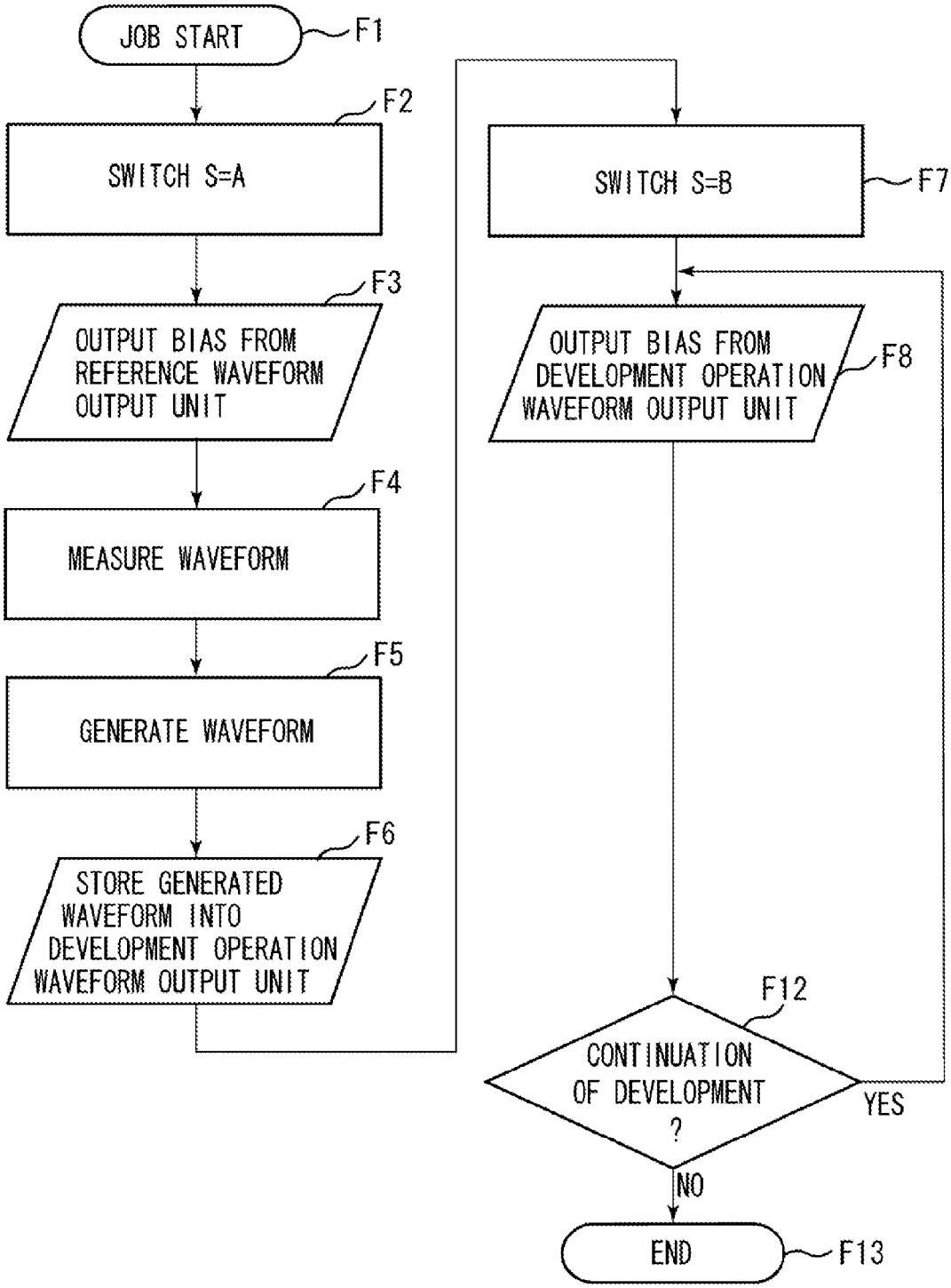
FIG. 9 is a flowchart illustrating a bias adjustment operation and a development operation according to a first exemplary embodiment of the present invention.
Figure 10:
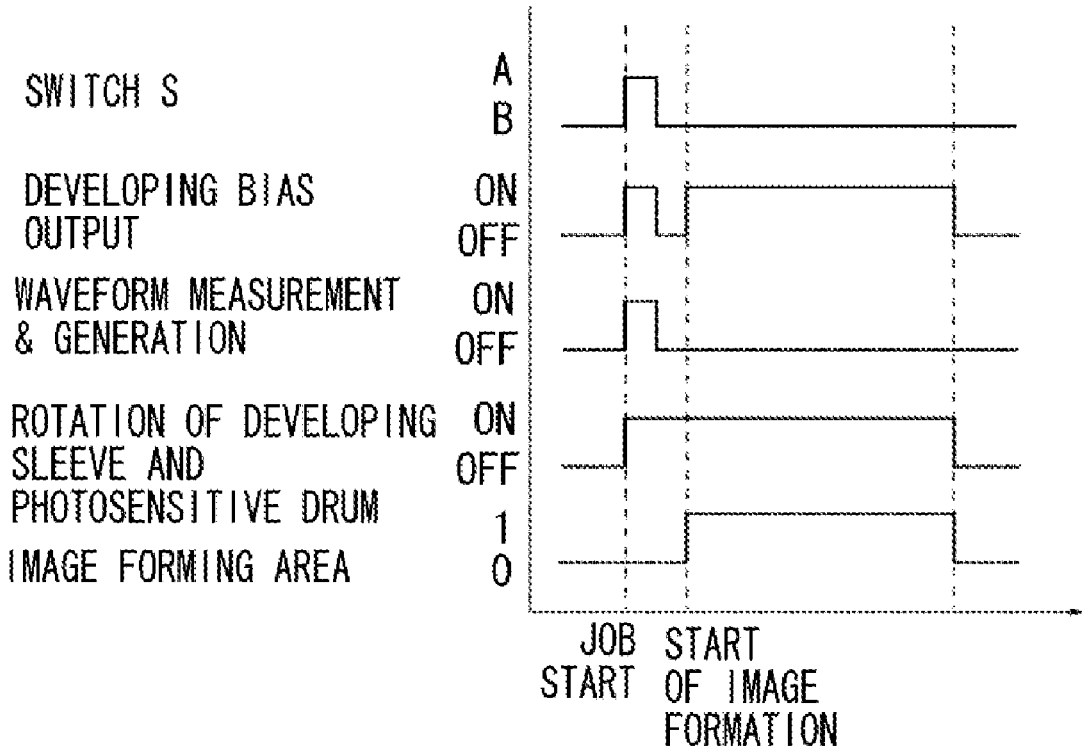
FIG. 10 is a timing diagram illustrating the bias adjustment operation and the development operation according to the first exemplary embodiment of the present invention.

FIG. 9 is a flowchart illustrating an operation of the developing bias generation circuit. FIG. 10 is a timing diagram illustrating the operation of the developing bias generation circuit. In step F1, both the developing sleeve 21 and the photosensitive drum 11 start rotating in response to a job start. In step F2, the switch (S) 4 selects the position "A."

At substantially the same time, in step F3, the reference waveform output unit 1 outputs a bias. The developing sleeve 21 receives, via the bias applying unit 5, the bias generated by the reference waveform output unit 1.

In step F4, the electrical potential detection unit 6 starts measuring an electrical potential waveform on the developing sleeve 21. The electrical potential detection unit 6 converts an analog signal of the measured waveform into digital data and transfers the digital data to the controller 3.

In step F5, the controller 3 generates a new waveform based on the measured waveform and the reference waveform stored in the reference waveform output unit 1. In step F6, the development operation waveform output unit 2 temporarily stores the newly generated waveform. The above-described sequential operations are referred to as "bias adjustment operation." The above-described bias adjustment operation is an operation performed on an area where no image appears on a sheet (i.e., an area where no image is formed).

Figure 11:
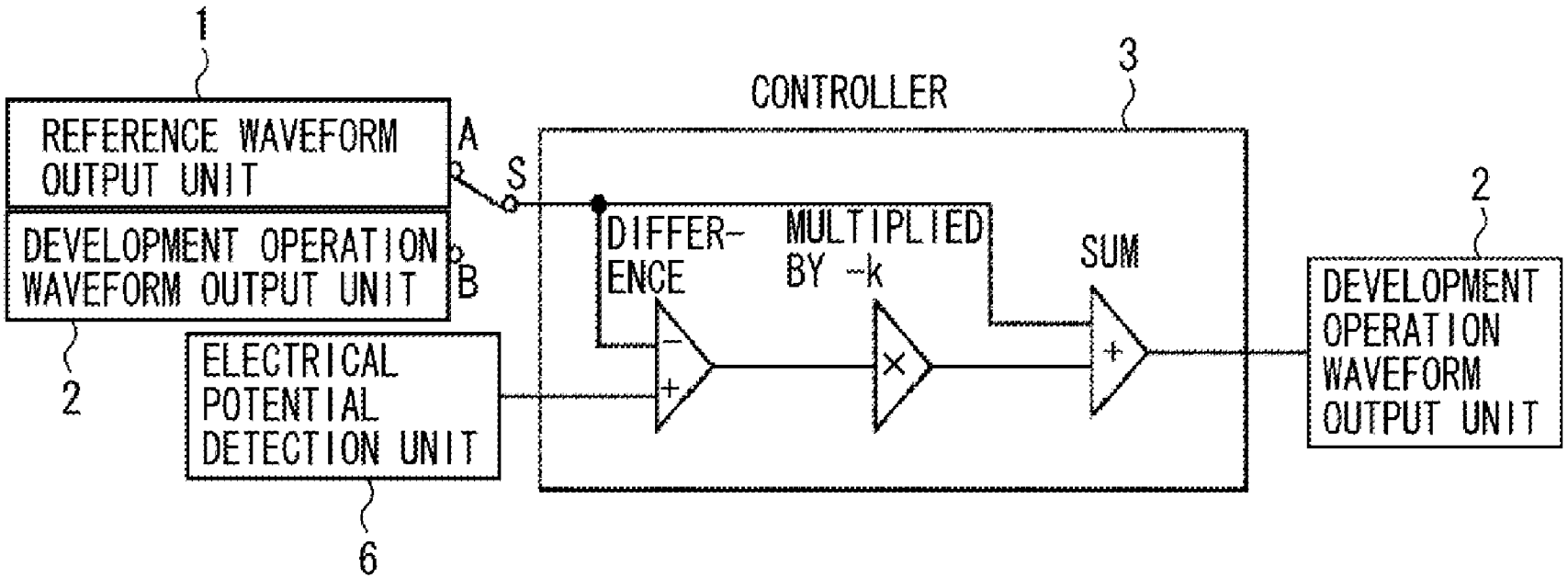
FIG. 11 is a block diagram illustrating a calculation unit according to an exemplary embodiment of the present invention.
Figure 12:
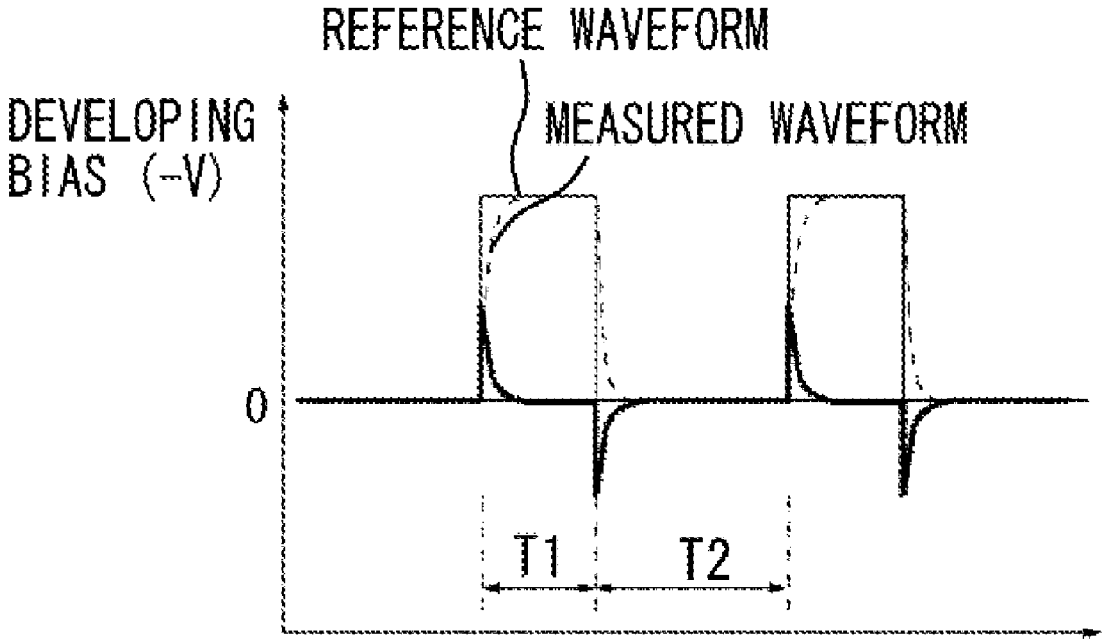
FIG. 12 illustrates an example waveform generated by the calculation unit according to an exemplary embodiment of the present invention, which is obtainable by multiplying a difference between a reference waveform and a measured waveform by a constant of $-k$ ($k=0.5$).

FIG. 11 illustrates an example circuit arrangement used for describing the above-described bias adjustment operation. In an exemplary embodiment, the controller 3 subtracts the reference waveform from the waveform measured by the electrical potential detection unit 6 and multiplies the obtained value by a predetermined coefficient (x−k) where (0.1<k<0.8)). In FIG. 12, a solid line represents a waveform obtained by multiplying the subtracted result by the coefficient (k=0.5). The reason for multiplying the subtracted result by a predetermined coefficient less than 1 is to prevent such a phenomenon that if the amount of correction for the input waveform is too large, the developing bias may oscillate to become unstable.

Figure 13:
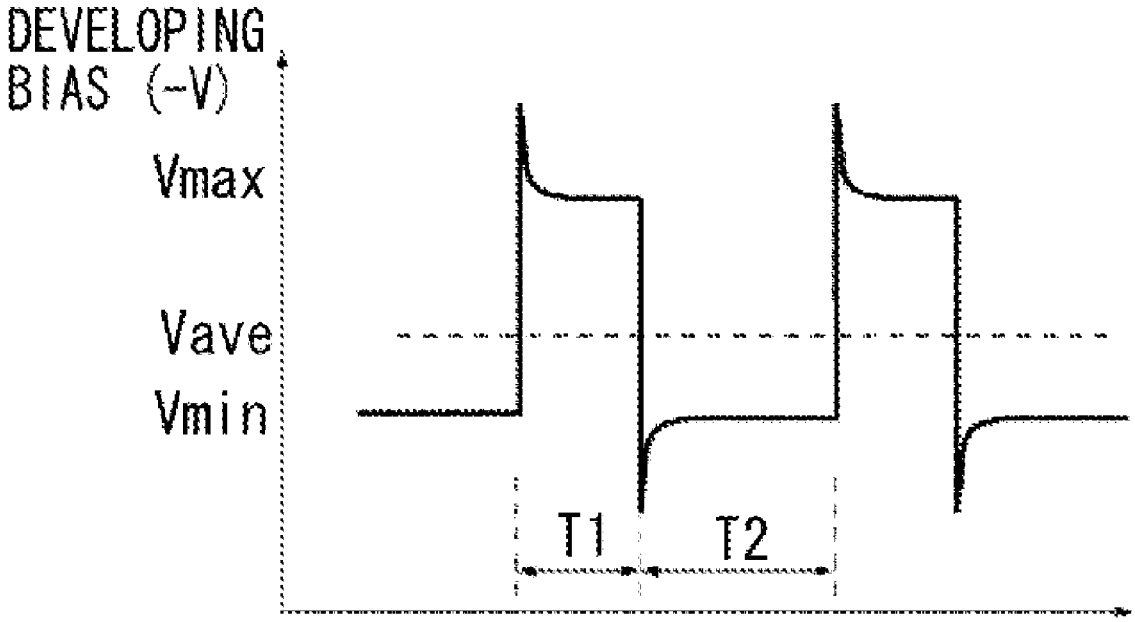
FIG. 13 illustrates an example waveform stored in a development operation waveform output unit.

Then, the controller 3 adds the reference waveform to the waveform obtained by multiplying the above-described subtracted result by the coefficient k. The development operation waveform output unit 2 stores an added result. FIG. 13 illustrates an example waveform stored in the development operation waveform output unit 2. The waveform illustrated in FIG. 13 is a waveform newly generated based on the result indicated by a dotted line (detection result obtained by the electrical potential detection unit) in FIG. 12.

Thus, an exemplary embodiment can convert a waveform, if it is slow in rise, into a waveform rising quickly to a high voltage. Applying a high voltage at rise timing can quickly charge the electrostatic capacitance of the S-D gap. The electric potential of the sleeve can promptly reach a predetermined voltage. The developing bias generation circuit uses the development operation waveform thus formed to perform the following development operation for an electrostatic image.

Figure 4:
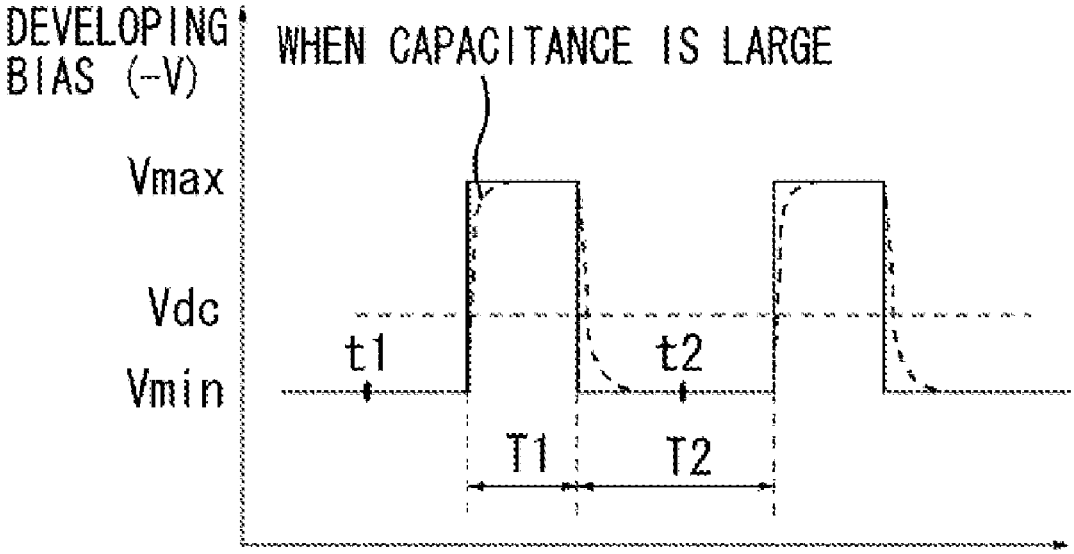
FIG. 4 PRIOR ART
FIG. 4 illustrates a waveform of developing bias in an electrostatic image forming unit.
Figure 5:
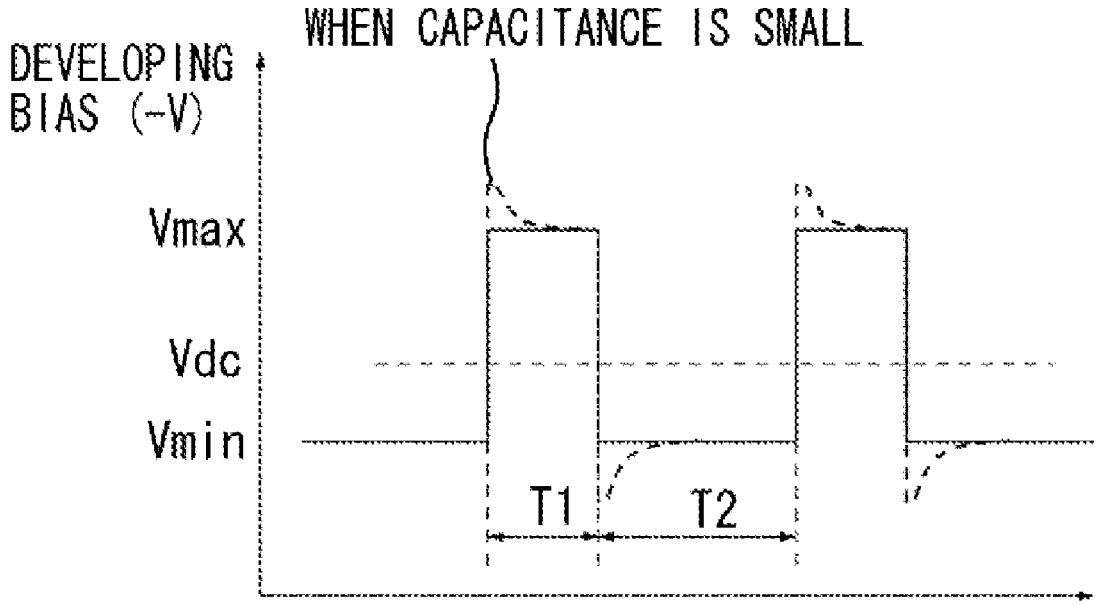
FIG. 5 PRIOR ART
FIG. 5 illustrates a waveform of developing bias in an electrostatic image forming unit.

To perform a calculation based on a waveform actually measured by an electrical potential detection unit and a stored waveform, the phase of the measured waveform is required to match the phase of the stored waveform. For example, an example method includes allocating time information to each period of the waveform generated by the reference waveform output unit 1. For example, pre-timing (t1) and post-timing (t2) are set before and after a pulse of the basic waveform illustrated in FIG. 4.

When the electrical potential detection unit 6 detects an output generated by the bias applying unit 5 based on the basic waveform, the electrical potential detection unit 6 acquires a detection result relating to the information of the pre-timing (t1) and the post-timing (t2). Thus, when the calculation is performed based on a comparison between the basic waveform and the detected waveform, the phase matching for respective data can be performed based on the pre-timing (t1) and post-timing (t2) information of respective waveforms.

Figure 14:
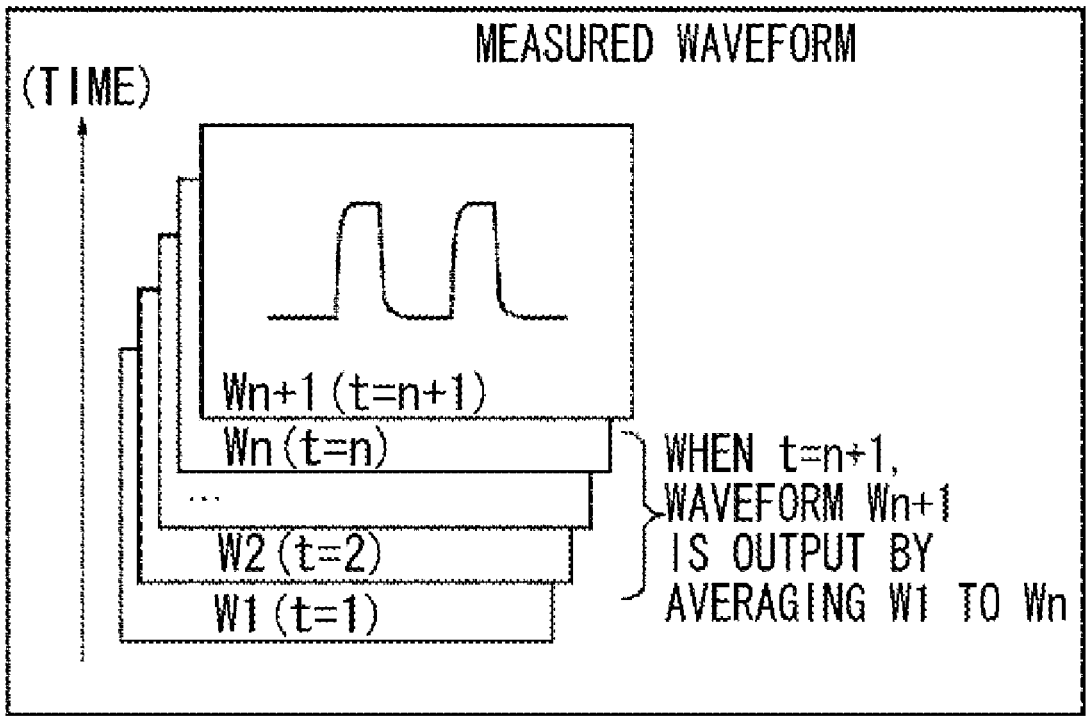
FIG. 14 illustrates an averaged waveform output from the development operation waveform output unit according to an exemplary embodiment of the present invention.

FIG. 14 illustrates a waveform stored in the development operation waveform output unit 2, which can be obtained by averaging a plurality of waveforms measured and calculated repetitively. The waveform measured in this manner momentarily varies depending on electric noises and disturbances. To minimize any errors caused by variations, it is desired to obtain an average waveform. The measured waveforms have phases matching each other because they are measured at the same time. According to FIG. 14, every waveform labeled with Wn (n=1, 2, . . . , n) includes two peaks. An averaged waveform can be obtained by averaging a plurality of waveforms of W1 to Wn in respective phases.

An example operation for developing an image forming area is described below with reference to FIGS. 9 and 10. In step F7, the switch (S) 4 selects the position "B" to start the operation for developing an image forming area. The development operation waveform output unit 2 is connected to the bias applying unit 5.

Next, in step F8, the development operation waveform output unit 2 outputs a previously generated waveform for a development operation as a bias via the bias applying unit 5. In this case, the development operation waveform output unit 2 continuously outputs the previously generated waveform. In other words, the developing bias generation circuit does not measure a waveform, does not newly generate a waveform, and does not update the waveform stored in the development operation waveform output unit 2.

In step F12, it is determined whether the development operation is to be continued. If it is determined that the development operation is to be continued (YES in step F12), the processing returns to step F8. If it is determined that the development operation is not to be continued (NO in step F12), the processing proceeds to step F13. In step F13, the developing bias generation circuit terminates the processing illustrated in FIG. 9.

The above-described bias adjustment operation is performed when the amount of image formation reaches a level corresponding to a predetermined number of sheets. As illustrated in FIG. 10, the bias adjustment operation is performed during a non-development period (i.e., in a state where no development operation is performed). Thus, an optimum developing bias waveform can be generated according to the latest state of the image forming apparatus. The bias waveform on the developing sleeve can be constantly equalized to the reference waveform. The image quality can be adequately maintained for a long time.

A copying machine including the above-described bias generation circuit was tested. In a test conducted to evaluate durability, the developing bias was a rectangular wave having the AC voltage set to 1.2 kVpp in amplitude, the frequency set to 6 kHz, and the DC voltage Vdc set to −350 V. The bias adjustment operation was performed every 10000 sheets having passed through the drum, which has a diameter of 30 mm and rotates at a circumferential speed of 300 mm/s.

An exemplary embodiment uses a charging efficiency Vrate as an index indicating developing performance, which is calculated based on an electrical potential Vf obtainable after development of toner. The following is a description relating to the charging efficiency.

Figure 6:
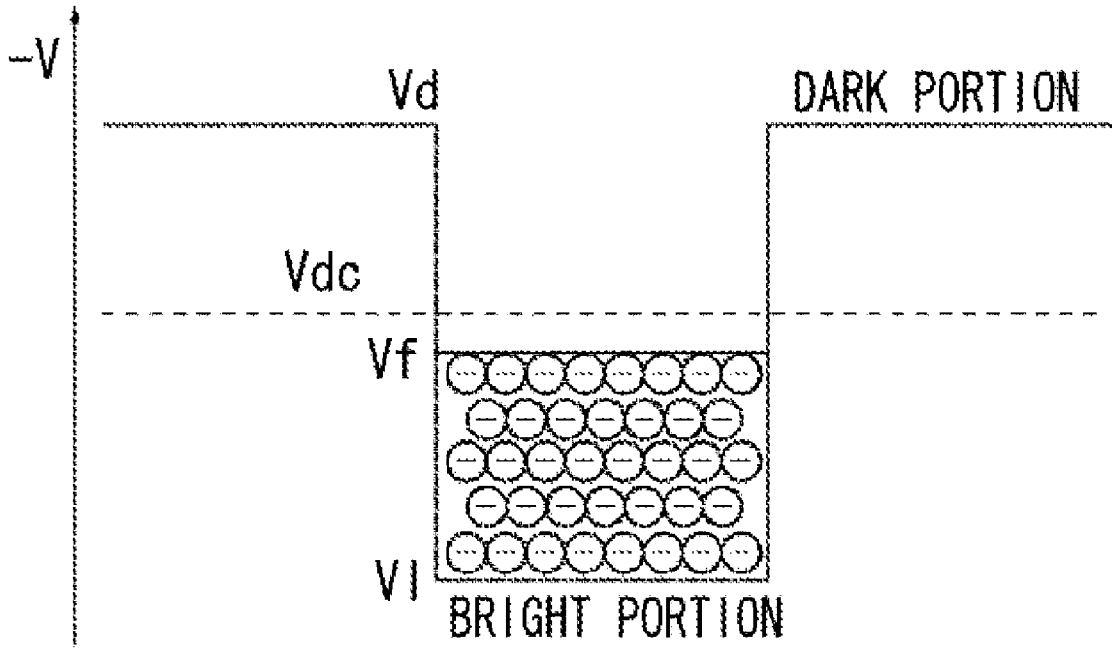
FIG. 6 illustrates a distribution of electrical potential on the surface of a photosensitive drum.
Figure 7:
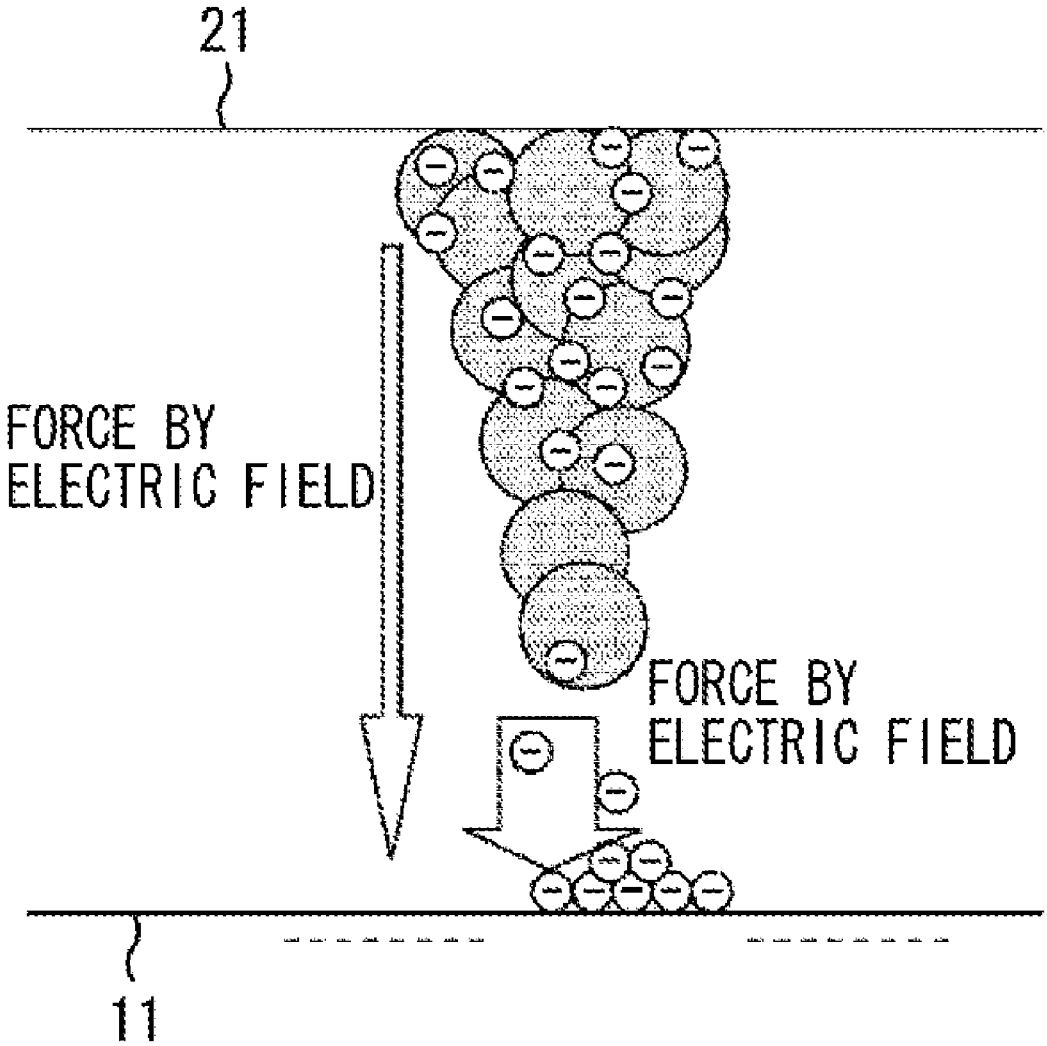
FIG. 7 PRIOR ART
FIG. 7 illustrates a magnetic brush generated in the S-D gap and the force acting on the magnetic brush under a developing electric field.

FIG. 6 illustrates a distribution of electrical potential on a photosensitive drum when a developing operation is performed. Vd represents an electrical potential of a non-exposed portion on a charged drum. Vl represents an electrical potential of an exposed portion. Vf represents an electrical potential of the upper surface of the toner layer.

Visualization of an electrostatic latent image, which is realized with flying toner particles, theoretically continues until the DC component Vdc of the developing bias accords with the electrical potential Vf of the surface of the toner layer. However, the DC component Vdc may not accord with the electrical potential Vf due to various factors. The charging efficiency Vrate is an index indicating the instantaneous degree of development relative to a target amount. The charging efficiency Vrate, which is expressed as a percentage, represents how the electrical potential Vf of the surface of the toner layer is close to the DC component Vdc.

More specifically, the following formula defines the charging efficiency when Vf represents the electrical potential of the upper surface of the toner layer, Vdc represents an integrated averaged developing bias value, and Vl represents the electrical potential of a bright portion on the photosensitive drum.

$$Vrate=(Vf-Vl)/(Vdc-Vl)\times 100$$

Figure 15:
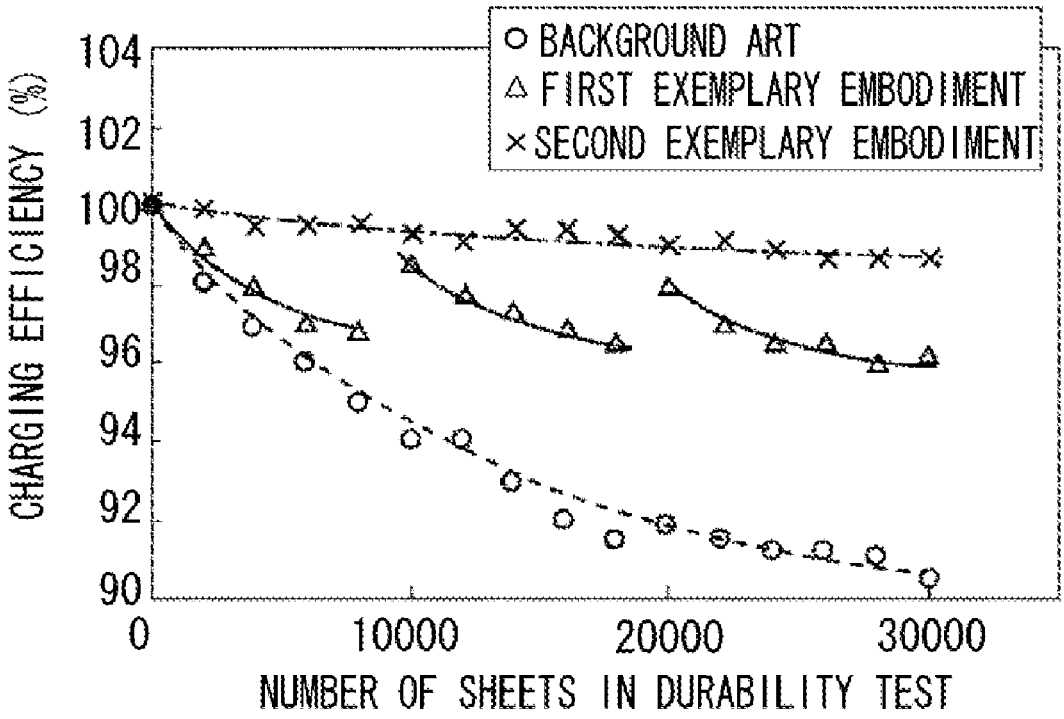
FIG. 15 is a graph illustrating a comparison of charging efficiency between an exemplary embodiment and a background art.

FIG. 15 illustrates a measurement result of the charging efficiency Vrate. In a comparison between the exemplary embodiments and a background art, the charging efficiency decreases similarly in an initial stage of the durability test. However, as understood from the measurement result, the charging efficiency was improved by the bias adjustment operation performed after 10000 sheets have passed through the drum. Compared to the result of the background art, charging efficiencies of the exemplary embodiments were maintained at higher levels throughout the durability test.

Figure 16:
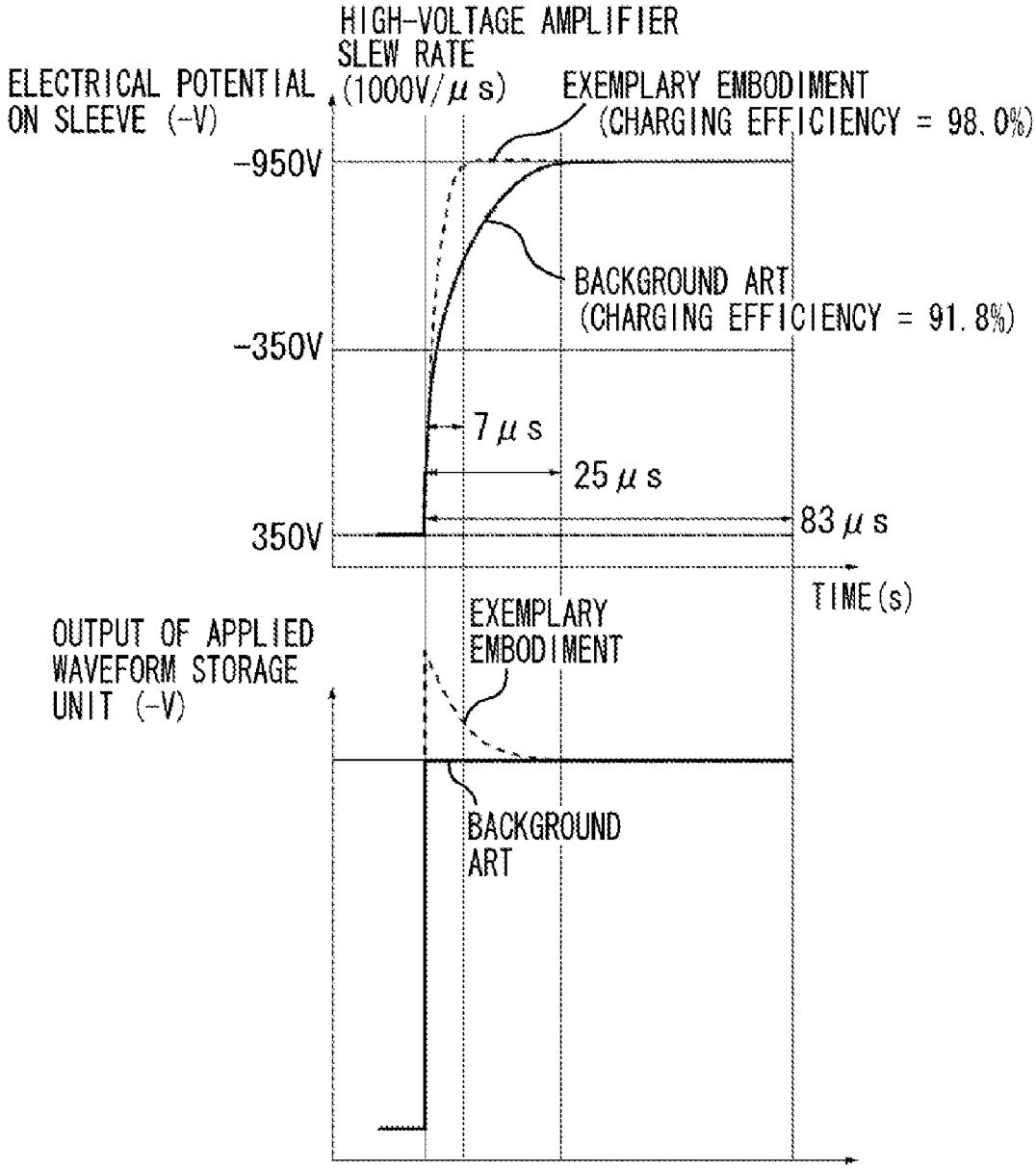
FIG. 16 is a graph illustrating a comparison of electrical potential rise of a sleeve and the waveform for a development operation between the first exemplary embodiment of the present invention and a background art.

FIG. 16 illustrates a waveform representing an electrical potential of the sleeve measured at the time corresponding to passage of a total of 20000 sheets. FIG. 16 illustrates, at its upper part, an actually measured waveform of the developing bias. FIG. 16 illustrates, at its lower part, an input waveform. Passage of 20000 sheets significantly decreases the S-D gap because the photosensitive drum and the regulating members (abutment rollers) of the developing sleeve were worn down. In such a state, the S-D gap has a large electrostatic capacitance. Therefore, the developing waveform in a conventional apparatus becomes dull as indicated by a solid line in FIG. 16.

On the other hand, the bias adjustment operation according to an exemplary embodiment can adjust the input waveform as indicated by a dotted line in the lower part of FIG. 16 and can obtain a sharp waveform as indicated by a dotted line in the upper part of FIG. 16. The electrical potential of the sleeve takes 25 μs to rise according to the background art and 7 μs according to an exemplary embodiment. Namely, the exemplary embodiment can realize a quick rise.

As illustrated in the lower part of FIG. 16, the background art applies a waveform having a rectangular rise. On the other hand, the waveform generated by the exemplary embodiment has a high voltage at rise timing and gradually decreases to a constant value. The voltage value at the initial rise determines the charging speed of the S-D gap and realizes a quick rise of the electrical potential of the sleeve.

The charging efficiency according to the background art was 91.8%, while the charging efficiency according to the exemplary embodiment was 98.0%. In other words, the quick rise realizes higher charging efficiency. Therefore, the exemplary embodiment can improve the developing performance.

The upper part of FIG. 16 also illustrates a slew rate of a high-voltage amplifier, as a limit of quick rise attainable by the high-voltage amplifier. An exemplary embodiment can realize improved waveform rise characteristics, which is comparable to the characteristics of the high-voltage amplifier.

As described above, the bias adjustment operation according to an exemplary embodiment can generate a bias waveform close to the reference waveform on the developing sleeve and can maintain high developing performance.

Second Exemplary Embodiment

Figure 18:
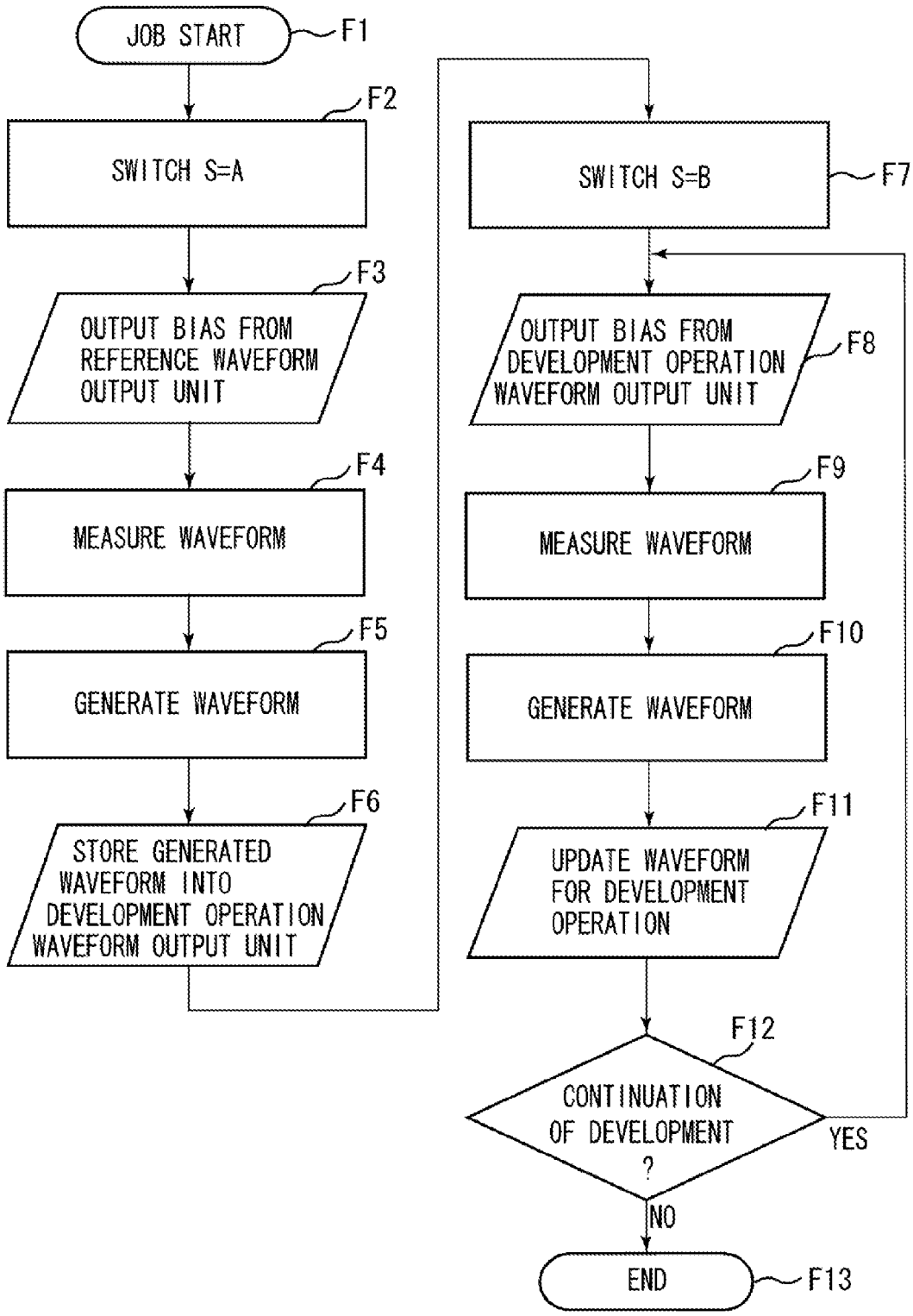
FIG. 18 is a flowchart illustrating a bias adjustment operation and a development operation according to the second exemplary embodiment of the present invention.
Figure 19:
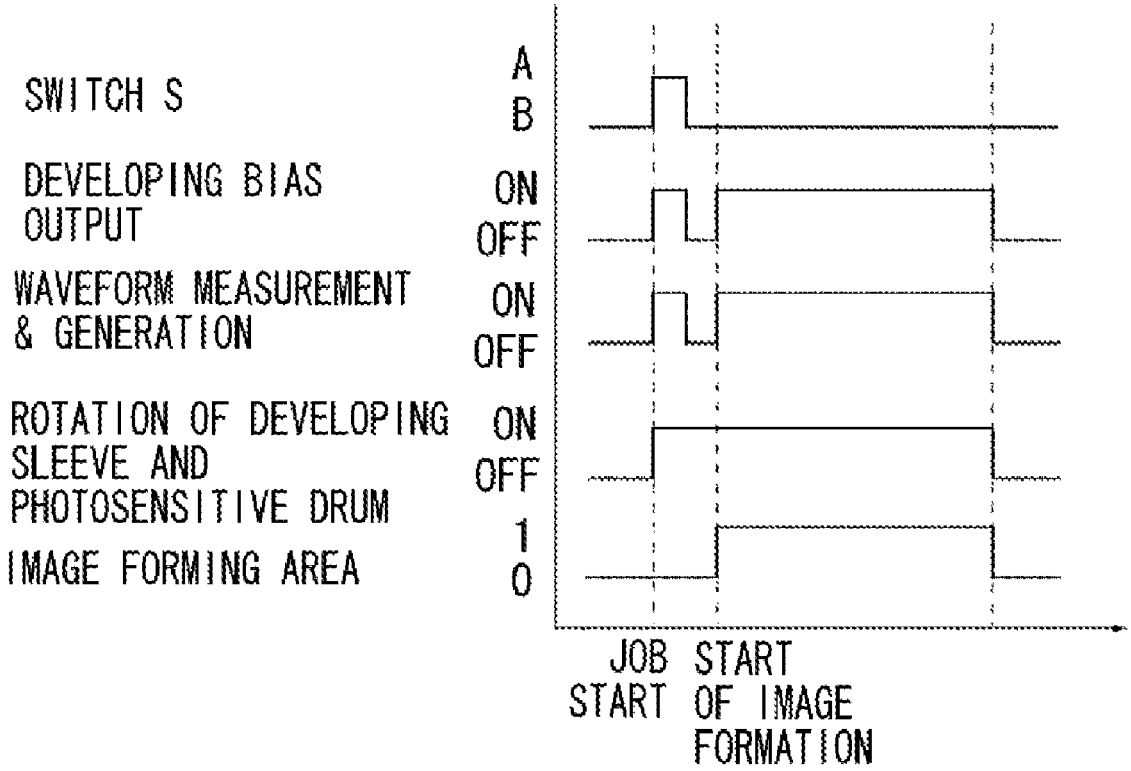
FIG. 19 is a timing diagram illustrating the bias adjustment operation and the development operation according to the second exemplary embodiment of the present invention.

A second exemplary embodiment of the present invention is described below with reference to a flowchart illustrated in FIG. 18 and a timing diagram illustrated in FIG. 19.

The initial operation (i.e., bias adjustment operation) according to the second exemplary embodiment is like the operation described in the first exemplary embodiment. In response to a job start (step F1), the switch 4 selects the position "A" (step F2). The reference waveform output unit 1 is connected to the bias applying unit 5. Then, both the developing sleeve 21 and the photosensitive drum 11 start rotating. In step F3, the reference waveform output unit 1 outputs a developing bias via the bias applying unit 5.

At the same time, in step F4, the electrical potential detection unit 6 starts detecting an electrical potential change on the developing sleeve 21. In step F5, the controller 3 generates a new waveform based on the measured waveform and the reference waveform stored in the reference waveform output unit 1. In step F6, the controller 3 transfers the newly generated waveform to the development operation waveform output unit 2. The development operation waveform output unit 2 temporarily stores the newly generated waveform. The above-described bias adjustment operation is an operation performed on an area where no image appears on a sheet (an area where no image is formed).

An image forming apparatus according to the second exemplary embodiment performs the following development operation.

In step F7, the switch 4 selects the position "B" to start a development operation. In step F8, the development operation waveform output unit 2 applies the stored waveform to the developing sleeve 21 via the bias applying unit 5. In step F9, the electrical potential detection unit 6 measures an electrical potential change on the developing sleeve 21. In step F10, the controller 3 generates a waveform based on the measurement result. In step F11, the controller 3 updates the waveform stored in the development operation waveform output unit 2. In step F12, it is determined whether the development operation is to be continued.

If it is determined that the development operation is to be continued (YES in step F12), the processing returns to step F8. In step F8, the development operation waveform output unit 2 again outputs a waveform. At this moment, the bias has a new waveform updated in step F11. Next, in step F9, the electrical potential detection unit 6 again measures an electrical potential change on the developing sleeve 21. In step F10, the controller 3 generates a waveform based on the measurement result. In step F11, the controller 3 updates the waveform stored in the development operation waveform output unit 2. In this manner, the second exemplary embodiment momentarily repeats application and updating of the bias waveform (i.e., processing in steps F8 to F12).

As described above, an exemplary embodiment can realize real-time updating of a bias waveform by appropriately performing a waveform detection during a development operation and reflecting a detected result to the waveform generation. The real-time updating of a bias waveform can prevent a bias from varying at rise timing when the S-D gap varies due to rotations of the sleeve and the drum.

The updating of an applied waveform can be performed at a time interval comparable to a plurality of wavelength periods, if the time interval is sufficient to follow up a variation of the S-D gap caused when the sleeve and the drum rotate. Furthermore, the waveform stored in the development operation waveform output unit 2 can be a waveform obtained by averaging a plurality of waveforms repetitively measured (FIG. 14). Appropriately setting the updating timing for an applied waveform and averaging waveforms can prevent a newly generated bias from being disturbed by noises.

A copying machine performing the above-described operation was tested. In a test conducted to evaluate durability, the developing bias was a rectangular wave having the AC voltage set to 1.2 kVpp in amplitude, the frequency set to 6 kHz, and the DC voltage Vdc set to −350 V. An exemplary embodiment updates the applied waveform in synchronization with sampling of a waveform for every five periods of the developing bias waveform. FIG. 15 illustrates the result. The second exemplary embodiment can stably maintain the charging efficiency at high levels compared to the first exemplary embodiment, according to which the developing bias adjustment is performed every 10000 sheets.

The second exemplary embodiment can realize real-time updating of the applied waveform. The bias waveform has a period repeated approximately 600 times during one complete rotation (360 degrees) of the drum, when the photosensitive drum has the above-described diameter, the circumferential speed, and the bias frequency. Thus, the waveform can sufficiently follow up. The second exemplary embodiment can adjust an applied bias waveform if any variation occurs in the S-D gap due to eccentricity of the drum. Therefore, the second exemplary embodiment can maintain still higher developing performance than the first exemplary embodiment.

Figure 17:
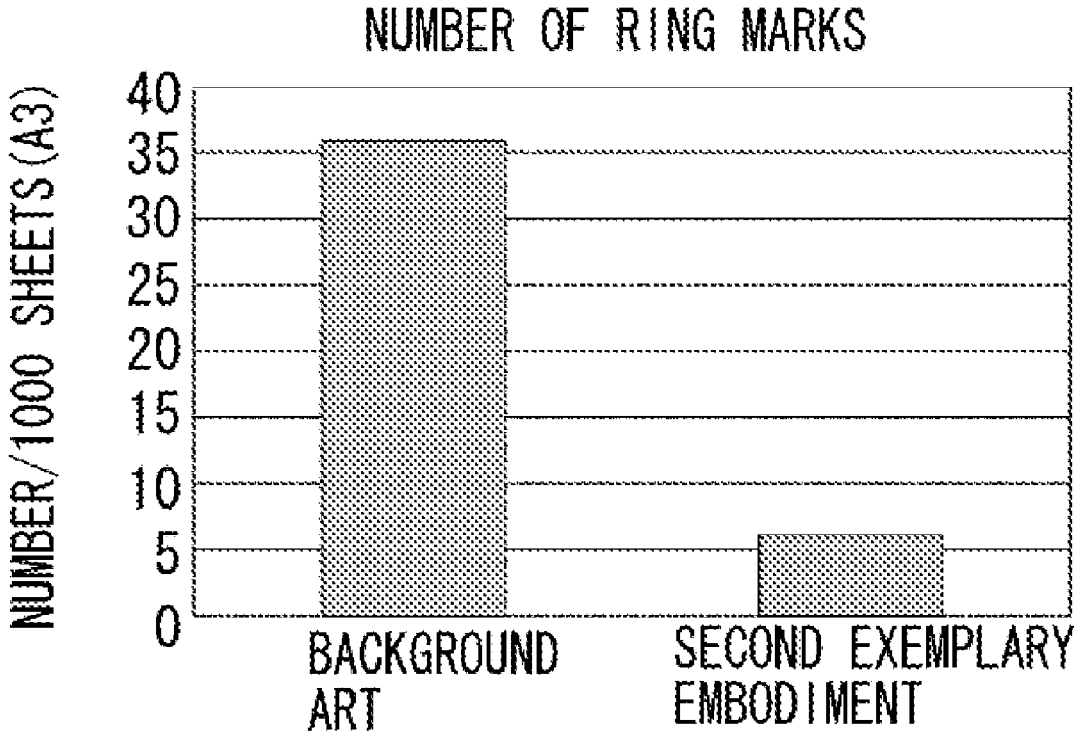
FIG. 17 is a graph illustrating a comparison in the number of generated ring marks between a second exemplary embodiment of the present invention and a background art.

FIG. 17 illustrates the number of ring marks having appeared on the 29001st to 30000th sheets used for the durability test, which indicates the number of abnormal discharges caused by the developing unit. Compared to the background art, the second exemplary embodiment can reduce the number of ring marks to approximately ⅙. In other words, by realizing a real-time developing bias correction, the second exemplary embodiment can reduce an overshoot appearing on the sleeve waveform when the S-D gap varies due to eccentricity and can reduce the occurrence of abnormal discharge.

As described above, an exemplary embodiment frequently performs the bias adjustment operation and generates a bias waveform close to the reference waveform on a developing sleeve and can maintain high developing performance.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-251889 filed Sep. 27, 2007, which is hereby incorporated by reference herein in its entirety.

What is claimed is:

1. A development device configured to develop an electrostatic image formed on an image bearing member by applying a developing bias in a development operation, the development device comprising:

a developer bearing member configured to bear a developer;

a bias applying unit configured to apply an input waveform bias including an alternating component to the developer bearing member;

a bias detection unit configured to detect information concerning an output waveform bias generated on the developer bearing member when the bias applying unit applies the input waveform bias to the developer bearing member; and a controller configured to execute a mode for controlling the developing bias to be applied to the developer bearing member based on information concerning a difference between the input waveform bias and the output waveform bias having a same phase.

2. The development device according to claim 1, wherein the controller is configured to control the developing bias to be applied to the developer bearing member in the development operation based on a detection result obtained by the bias detection unit in a non-development operation.

3. The development device according to claim 1, wherein the controller is configured to control the developing bias to be applied to the developer bearing member in the development operation based on a detection result obtained by the bias detection unit in the development operation.

4. The development device according to claim 1, wherein the input waveform bias includes a waveform having a rectangular portion.

5. The development device according to claim 1, further comprising a memory configured to store information concerning a waveform for generating the input waveform bias, wherein the bias applying unit is configured to apply the input waveform bias to the developer bearing member based on the information stored in the memory.

6. A development device configured to develop an electrostatic image formed on an image bearing member by applying a developing bias in a development operation, the development device comprising:

a developer bearing member configured to bear a developer;

a bias applying unit configured to apply an input waveform bias including an alternating component to the developer bearing member;

a bias detection unit configured to detect information concerning an output waveform bias generated on the developer bearing member when the bias applying unit applies the input waveform bias to the developer bearing member; and a controller configured to execute a mode for controlling the developing bias to be applied to the developer bearing member based on the input waveform bias and the output waveform bias, wherein the controller is configured to execute the mode based on a number of times of the development operation.

7. A development device configured to develop an electrostatic image formed on an image bearing member by applying a developing bias in a development operation, the development device comprising:

a developer bearing member configured to bear a developer;

a bias applying unit configured to apply an input waveform bias including an alternating component to the developer bearing member;

a bias detection unit configured to detect information concerning an output waveform bias generated on the developer bearing member when the bias applying unit applies the input waveform bias to the developer bearing member;

a controller configured to execute a mode for controlling the developing bias to be applied to the developer bearing member based on the input waveform bias and the output waveform bias; and a phase detection unit configured to detect a phase of the input waveform bias and a phase of the output waveform bias.

8. A development device configured to develop an electrostatic image formed on an image bearing member by applying a developing bias in a development operation, the development device comprising:

a developer bearing member configured to bear a developer;

a bias applying unit configured to apply an input waveform bias including an alternating component to the developer bearing member;

a bias detection unit configured to detect information concerning an output waveform bias generated on the developer bearing member when the bias applying unit applies the input waveform bias to the developer bearing member; and a controller configured to control the developing bias to be applied to the developer bearing member based on the input waveform bias and the output waveform bias so as to decrease a difference between the input waveform bias and the output waveform bias having a same phase.

* * * * *